United States Patent [19]

Nagakura et al.

[11] Patent Number: 5,068,693

[45] Date of Patent: Nov. 26, 1991

[54] SHEET PATH SENSOR PROVIDED IN AN ELECTROPHOTOGRAPHIC IMAGE FORMING APPARATUS

[75] Inventors: Masanao Nagakura; Masato Kawashima, both of Kawasaki, Japan

[73] Assignee: Fujitsu Limited, Kawasaki, Japan

[21] Appl. No.: 530,533

[22] Filed: May 30, 1990

[30] Foreign Application Priority Data

Jun. 5, 1989 [JP] Japan ..... 1-142750

[51] Int. Cl.[5] ..... G03G 21/00

[52] U.S. Cl. ..... 355/315; 355/206

[58] Field of Search ..... 355/203, 206, 205, 311, 355/315, 309

[56] References Cited

U.S. PATENT DOCUMENTS

| | | | |
|---|---|---|---|
| 3,693,969 | 9/1972 | Sakamaki et al. | 355/309 X |
| 4,244,648 | 1/1981 | Schultes et al. | 355/206 |
| 4,937,622 | 6/1990 | Makiura | 355/206 |

*Primary Examiner*—A. T. Grimley
*Assistant Examiner*—Shuk Y. Lee
*Attorney, Agent, or Firm*—Armstrong, Nikaido, Marmelstein, Kubovcik & Murray

[57] ABSTRACT

A mechanical sheet path sensor used in an electrophotographic image forming apparatus for transcribing image onto a cut sheet by using a toner image formed on a rotating photosensitive drum, for sensing a cut sheet passing therethrough and is placed between a peel-off unit for peeling off the cut sheet after image transcription is performed by an image transcribing unit and a fixing unit for fixing the toner image transcribed on the cut sheet so that a distance from the peel-off unit to the sheet path sensor is shorter than a distance measured along the circumference of the drum from the image transcribing unit to a cleaning unit for cleaning the toner left on the drum after the image transcription. The sensor touches only a side zone where the toner image is forbidden to be transcribed, for avoiding the toner image, not fixed, on the cut sheet from damaging.

4 Claims, 7 Drawing Sheets

SHEET PATH SENSOR PROVIDED IN AN ELECTROPHOTOGRAPHIC IMAGE FORMING APPARATUS

BACKGROUND OF THE INVENTION

1. Field of the Invention

The present invention relates to a sheet path sensor provided in an electrophotographic image forming apparatus, and in particular, to an arrangement of a sheet path sensor in the electrophotographic image forming apparatus, for mechanically sensing the path of a cut sheet having a toner image not fixed, without damaging the toner image.

An electrophotographic image forming apparatus, which will be simply called an "image forming apparatus" hereinafter, is classified into two types from a view point of an image transcription medium, such as a type of using a continuous sheet and a type of using a cut sheet, and the present invention relates to the type of using a cut sheet.

2. Description of the Related Art

FIG. 1 shows a schematic side view of an image forming apparatus for illustrating a forming and a transcribing process of a toner image onto a cut sheet and a transferring process of the cut sheet along a sheet transfer route 104 through sheet path sensors S1 and S2 which relate to the present invention.

In FIG. 1, the image forming process is performed by using a photosensitive drum 1 which will be simply called a "drum 1" hereinafter. The drum 1 turns in a clockwise direction R on its axis O so that a cylindrical surface of the drum 1 is turned at a constant speed of, for example, 51 mm/sec. The cylindrical surface of drum 1 is made of a photosensitive material such as selenium and is initially electrostatically charged by a pre-charging unit 7. After the cylindrical surface is pre-charged, a latent image is formed on the cylindrical surface by a latent image forming unit 4 in accordance with an electrical image signal given to the latent image forming unit 4. When the cylindrical surface turns further, the latent image formed on the cylindrical surface is developed by a developing unit 5, and a toner image is produced on the cylindrical surface. The above process can be called an image forming process.

On the other hand, in synchronization with the image forming process, a sheet transferring process is performed together with an image transcribing process. One of cut sheets stocked in a sheet supplying cassette 8 is picked out therefrom by a pick-out roller 9 and sent to a driving roller consisting of two rollers 10 and 11. The cut sheet driven by the driving rollers 10 and 11 is sent to a gap made between the turning cylindrical surface of the drum 1 and an image transcribing unit 2 so that a front (upper in FIG. 1) surface of the cut sheet touches the turning cylindrical surface of the drum 1. During the time that the cut sheet passes through the image transcribing unit 2, the toner image on the cylindrical surface is transcribed on the surface of the cut sheet and, immediately, the cut sheet is peeled off from the cylindrical surface by a sheet peel-off unit 3 adjacent to the image transcribing unit 2. The cut sheet peeled off from the cylindrical surface by the peel-off unit 3 is sent to a fixing unit 6 where the toner image transcribed on the cut sheet is thermally fixed, and the fixed cut sheet is sent to an exhausted sheet tray 14. After the cut sheet is stacked into the exhausted sheet tray 14, the next sheet transferring process starts in synchronization with the next image forming process. Thus, the transfer of the cut sheets is continuously performed until a series of the image signals is over.

On the sheet transfer route 104, two sheet path sensors, a first sheet path sensor S1 and a second sheet path sensor S2, are provided for sensing a cut sheet passed therethrough. The first sheet sensor S1 is placed at the entrance of the cut sheet to the image transcribing unit 2, and a second sheet path sensor S2 is placed at the position where the cut sheet has been peeled off from the drum 1 by the peel-off unit 3. By the peel-off unit 3, it sometimes occurs that the cut sheet cannot be peeled off from the cylindrical surface, running with the turning cylindrical surface. This causes sheet clogging at the turning cylindrical surface, in particular, at a gap between the drum 1 and a cleaner 15. The cleaner 15 is for cleaning toner left on the cylindrical surface after the image description. If sheet clogging occurs, it takes time to remove the clogged cut sheet from the gap and there is the possibility of scratching the cylindrical surface and damaging the cleaner 15 when the clogged cut sheet is removed. Therefore, if it occurs that the cut sheet is not peeled off from the cylindrical surface by the peel-off unit 3, the drum 1 must be immediately stopped from turning before sheet clogging occurs. The first and second sheet path sensors S1 and S2 are for confirming whether the cut sheet is safely pealed off from the cylindrical surface. That is, if the second sheet path sensor S2 outputs no information about the cut sheet even though the cut sheet has passed through the first sheet path sensor S1, the image forming apparatus judges that the cut sheet is not peeled off from the cylindrical surface, and the apparatus stops the drum 1 from turning by a drive control circuit 100 provided in the image forming apparatus. The drive control circuit 100 is not depicted in FIG. 1 but is shown in FIG. 2. FIG. 2 is a schematic block diagram of the drive control circuit 100 and FIGS. 3(*a*) to 3(*d*) are the time charts for explaining the function of the drive control circuit 100. In FIGS. 2, 4(*a*) and 4(*b*), the same reference symbol as in FIG. 1 designates the same unit or signal as in FIG. 1. In FIG. 2, the blocks each depicted with a solid line are units composing the drive control circuit 100 and other blocks each depicted by a one dot chained line are other units of the image forming apparatus shown in FIG. 1, and solid connecting lines indicate electrical connection and dotted connecting lines indicate mechanical or optical connection.

In FIG. 2, the drive control circuit 100 operates as follows. An image signal to form an image by image transcription on the cut sheet is sent to the latent image forming unit (LATENT IMAGE FORM) 4 and to an image signal sensing circuit (IMAGE SIG FENS) 101 at the same time. When the IMAGE SIG FENS 101 receives the image signal, the IMAGE SIG FENS 101 outputs sensed signals A1, A2 and A3 to a drive controller (DRIVE CONT) 102, the LATENT IMAGE FORM 4 and the pick-up roller (PICK-UP ROLLER) 9 respectively, with proper timing differences among them. When DRIVE CONT 102 receives the sensed signal A1, DRIVE CONT 102 controls a drive motor (DRIVE MOT) 103 so that DRIVE MOT 103 turns the drum (DRUM) 1, using power supplied from a power supply (POWER SUPP) 110. When LATENT IMAGE FORM 4 receives the image signal with the sensed signal A2, a scanned optical beam modulated by the image signal is output to the cylindrical surface of DRUM 1 from LATENT IMAGE FORM UNIT 4, producing a latent image on the cylindrical surface of DRUM 1. The latent image on the cylindrical surface is developed by the developing unit 5 so as to produce a toner image on the cylindrical surface, and the toner image on the cylindrical surface is moved to the image transcribing unit 2 where the toner image is transcribed onto the front surface of the cut sheet. The developing unit 5 is not depicted in FIG. 2. When the sensed signal A3 is applied to PICK-UP ROLLER 9, PICK-UP ROLLER 9 picks up a cut sheet so that the cut sheet is transferred along the sheet transfer route (SHEET TRANS ROUTE) 104 on which the first sheet path sensors S1, the image transcribing unit (IMAGE TRANS) 2, the sheet peel-off unit (PEEL OFF) 3, the fixing unit (FIX) 6 and the second sheet path sensor S2 are provided as shown in FIG. 2. When the cut sheet passes through S1 provided between PICK-UP ROLLER 9 and IMAGE TRANS 2, a passage signal B1 is output from S1 and sent to both a sheet passage signal generator (SHEET PATH GEN) 105 and a reference signal generator (REF GEN) 106. When the cut sheet passes through S2 provided at a place where the cut sheet has been passed through PEEL-OFF 3, another passage signal B2 is output from S2 and sent to SHEET-PATH GEN 105. The passage signals B1 and B2 are shown in FIGS. 3(*a*) and 3(*b*) respectively. When the passage signals B1 and B2 are sent to SHEET-PATH GEN 105, SHEET-PATH GEN 105 produces a sheet-path signal C1 so that the leading edge and the trailing edge of C1 are determined by the leading edges of B1 and B2 respectively as shown in FIGS. 3(*a*) to 3(*c*). On the other hand, when REF GEN 106 receives $B_1$, REF GEN 106 produces a reference signal C2 having a time width $t_w$, providing a time interval of a reference time $T_r$ from the leading edge of B1. The reference time $T_r$ is previously determined in consideration of the turning speed of the cylindrical surface of DRUM 1 and a distance between PEEL OFF 3 and S2 on SHEET TRANSFER ROUTE 104, and the time width $t_w$ is also previously fixed for making an AND circuit (AND) 107, which will be explained below, operate properly. The C1 from SHEET-PATH GEN 105 and C2 from REF GEN 106 are ANDed by AND 107 for detecting whether C1 is terminated within $T_r$. That is, if C1 is terminated within $T_r$ as shown by C1 depicted with a solid line, AND 107 outputs no signal, however, if C1 is not terminated within $T_r$ as shown by C1 depicted with a dotted line, AND 107 outputs an AND output signal. When the AND output signal is output from AND 107, the AND output signal is sent to a switching circuit (SW) 108. When SW 108 receives the AND output signal, SW 108 produces a stop signal for stopping DRIVE MOT 103 and sends the stop signal to DRIVE CONT 102. The SW 108 is a flip-flop circuit so that when the stop signal is output from SW 108 once, the stop signal is indefinitely output from SW 108 unless a reset switch (RESET) 109 is operated. This means that if S2 does not operate even though S1 operates, in other words, if the cut sheet does not arrive at S2 in the reference time $T_r$, the drive control circuit 100 judges that the cut sheet is not peeled off from the cylindrical surface and stops DRIVE MOT 103. This stop situation is continued until RESET 109 is operated, and during the time that DRIVE MOT 103 is stopped, the cut sheet not peeled off from the cylindrical surface is removed. Actually, the stop signal from SW 108 is used not only for stopping DRIVE MOT 103 but also for controlling the image signal so as not to be sent to LATENT IMAGE FORM 4 and IMAGE SIG SENS 101, and the stopping of DRUM 1 is indicated by a proper indicator. These other circuits relating to the stop signal are not depicted in FIG. 2.

When the image transcription is stopped because of S2, the operator checks the cut sheet not peeled off and removes carefully the cut sheet from the cylindrical surface, and re-starts the apparatus by operating RESET 109.

In the above related art, even though the first and second sheet path sensors S1 and S2 operate with the drive control circuit 100, there is still a problem if the cut sheet happens to be clogged as stated in reference to FIG. 1 when the distance between PEEL OFF 3 and S2 is too far on SHEET TRANS ROUTE 104 in comparison with a distance between IMAGE TRANS 2 and the cleaner 15 as seen from FIG. 1. That is, as can be seen in FIGS. 1 and 2, S2 must be placed far from FIX 6 on SHEET TRANS ROUTE 104, looking from PEEL OFF 3. Because, since S2 is mechanical sensor such as a microswitch and runs on a toner image on the cut sheet and the toner image is not fixed yet, the toner image on the cut sheet is easily harmed by the mechanical touch of S2 if S2 is placed near from FIX 6, looking from PEEL OFF 3.

Instead of the mechanical sensor, a photosensitive sensor can be used if a cut sheet made of paper is only used. For example, Japanese Patent SHO 54-136844 to S. Suzuki in Oct. 24, 1979 is a typical case that the photosensitive sensors are used for sensing the paper cut sheet. In the case of using the photosensitive sensor, it is not necessary to worry that the toner image will be damaged by the sheet path sensor even though the sheet path sensor is placed near from the fixing unit, looking from the peel-off unit. However, in the present invention, the image forming apparatus may use not only a paper cut sheet but also an optically transparent cut sheet such as an overhead projector cut sheet. Therefore, a photosensitive sensor cannot be applied to the second sheet path sensor S2. The photosensitive sensor would be ineffective to detect the optically transparent cut sheet. Therefore, in consideration of using such optically transparent cut sheet, the second sheet sensor S2 must be a mechanical sensor placed far from the fixing unit 6, looking from the peel-off unit 3, as shown in FIGS. 1 and 2. Accordingly, in the related art, when an optically transparent cut sheet is used, the occurrence of cut sheet clogging has been an unavoidable problem for the image forming apparatus.

SUMMARY OF THE INVENTION

An object of the present invention is to improve the image forming apparatus so that cut sheet clogging does not occur when the mechanical sensor is used in the image forming apparatus for sensing a cut sheet, which is not only a paper cut sheet but also an optically transparent cut sheet, passed through the peel-off unit of the image forming apparatus.

Another object of the present invention is to save time needed to remove the clogged cut sheet from the image forming apparatus when the cut sheet is not peeled off from the cylindrical surface of the drum by the peel-off unit.

Still another object of the present invention is to prevent the cylindrical surface of the drum and/or the cleaner of the image forming apparatus from being damaged.

Yet another object of the present invention is to increase the operation reliability of the image forming apparatus.

The above objects of the present invention are achieved by using a mechanical sensor for the second sheet path sensor and placing the second sheet path sensor at a point having a distance from the peel-off unit on the sheet transfer route shorter than a distance between the image transcribing unit and the cleaner along the cylindrical surface of the drum, and by arranging the second sheet path sensor so that the second sheet path sensor mechanically touches only a forbidden zone, which is a zone in which the toner image is forbidden to be transcribed, of the cut sheet.

BRIEF DESCRIPTION OF THE DRAWINGS

FIG. 4(*b*) is a schematic side view of the image forming apparatus embodying the present invention, for illustrating a position of the second sheet path sensor;

DESCRIPTION OF THE PREFERRED EMBODIMENT

Figure 1:
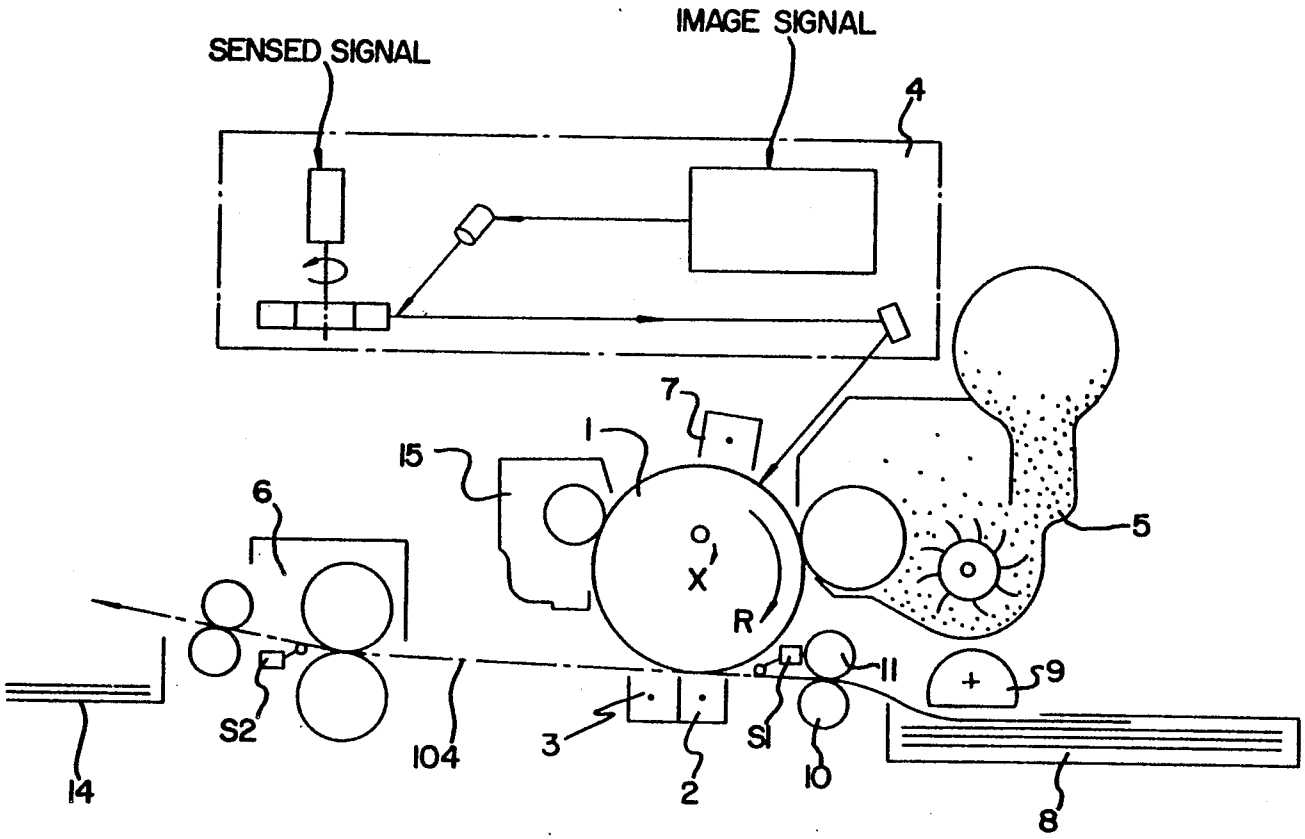
FIG. 1 is a schematic side view of an image forming apparatus of the related art, for illustrating the function of the image forming apparatus and of sheet path sensors provided on a sheet transfer route of the image forming apparatus.
Figure 4A:
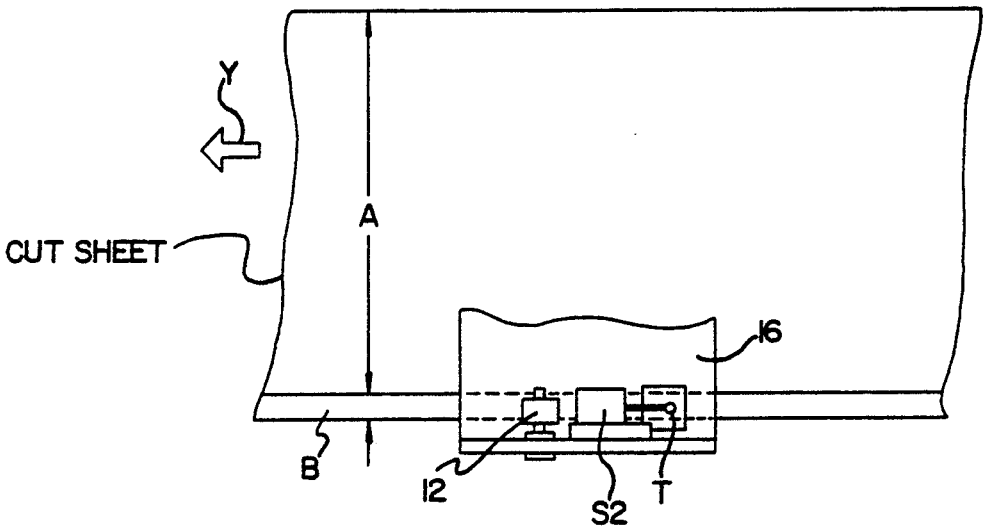
FIG. 4(*a*) is a schematic plan view of a part, relating to a second sheet path sensor, of an image forming apparatus embodying the present invention.
Figure 4B:
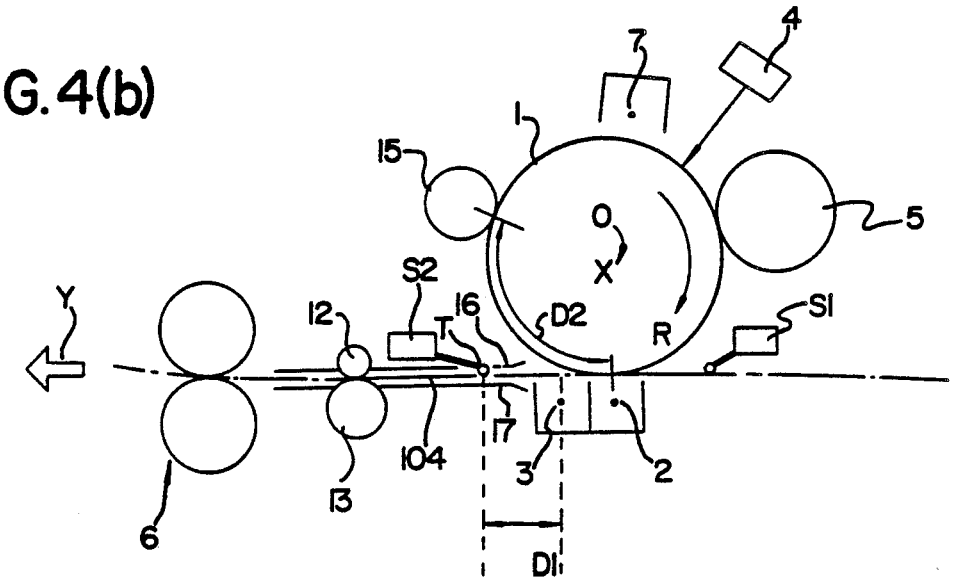

FIGS. 4(*a*) and 4(*b*) are a plan view, respectively, and a side view for illustrating the basic principle of the image forming apparatus embodying the present invention. In FIGS. 4(*a*) and 4(*b*), the same reference numeral as in FIGS. 1 and 2 designates the same unit as in FIGS. 1 and 2. In FIGS. 4(*a*) and 4(*b*), the units arranged on the sheet transfer route 104 are arranged same as in FIG. 1 or 2 except the second sheet path sensor S2. The units are arranged as follows: the image transcribing unit 2 and the peel-off unit 3 are arranged adjacent to the drum 1; the first sheet path sensor S1 is arranged at the front, looking along a sheet transfer direction Y, of the image transcribing unit 2 for sensing that the cut sheet is intended to be fed into the gap between the image transcribing unit 2 and the drum 1; sheet driving rollers 12 and 13 are set between the peel-off unit 3 and the fixing unit 6 on the sheet transfer route 104, for driving the cut sheet only by touching the forbidden zone B (see FIG. 4(*a*)) of the cut sheet. Zone A is a zone on which the toner image is transcribed; and the second sheet path sensor S2 is arranged between the peel-off unit 3 and the driving rollers 12 and 13 so that a distance $D_1$ between the peel-off unit 3 and a tip T, for touching the cut sheet, of a lever of the sheet path sensor S2 is shorter than a distance $D_2$ between the image transcribing unit 2 and the cleaner 15 along the cylindrical surface of the drum 1.

Figure 2:
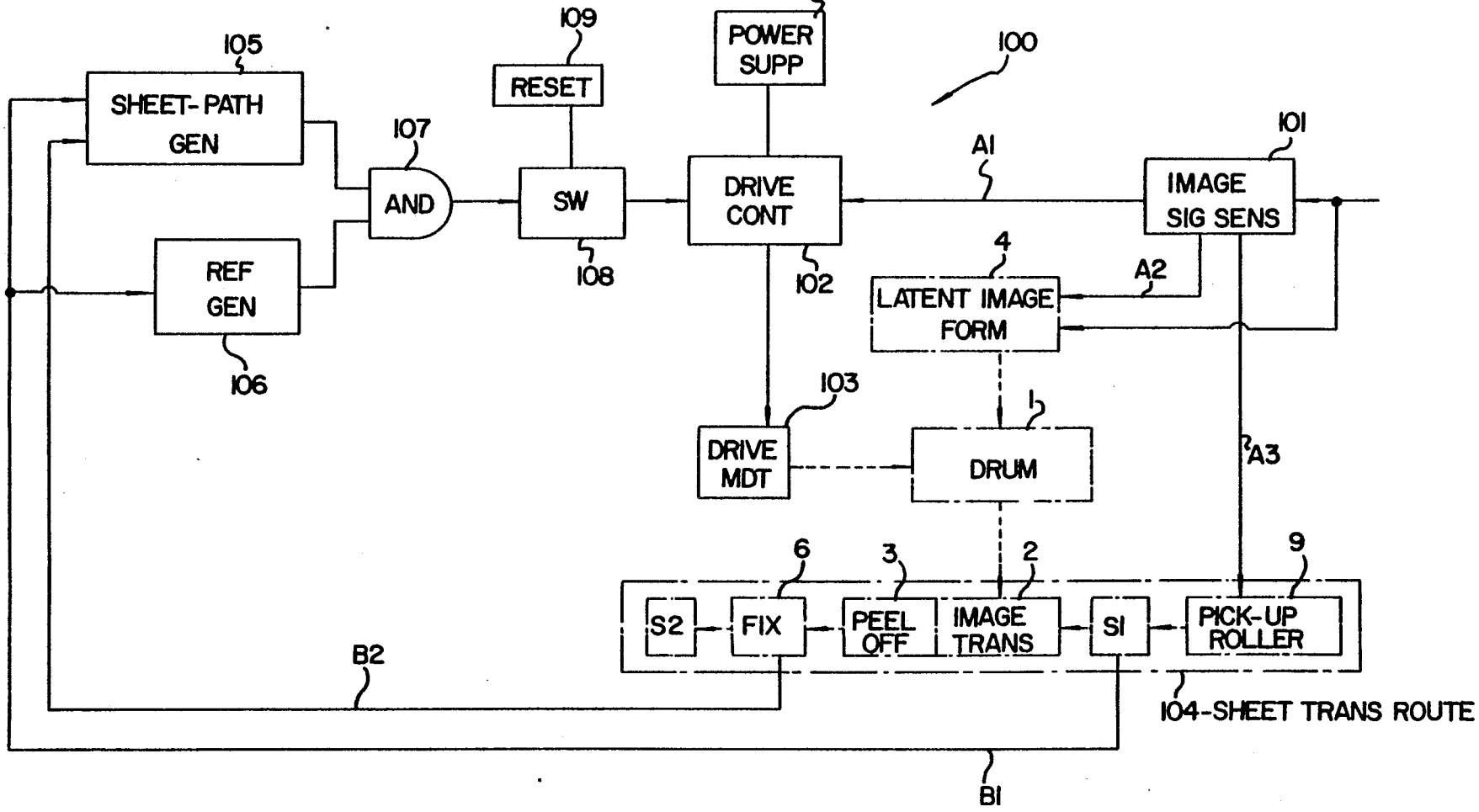
FIG. 2 is a block diagram of a drive control circuit relating to the sheet sensors, generally provided in an image forming apparatus.
Figure 3A:
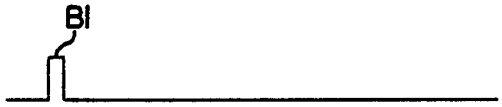
FIGS. 3(*a*) to 3(*d*) are time charts for explaining the operation of the drive control circuit.
Figure 3B:
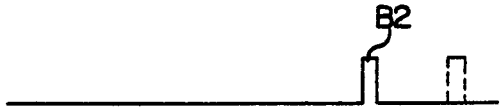
Figure 3C:
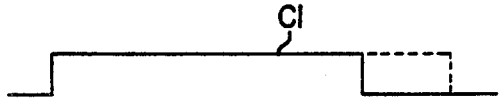
Figure 3D:
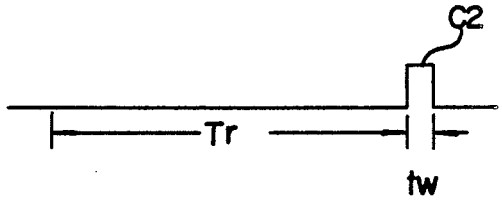
Figure 5:
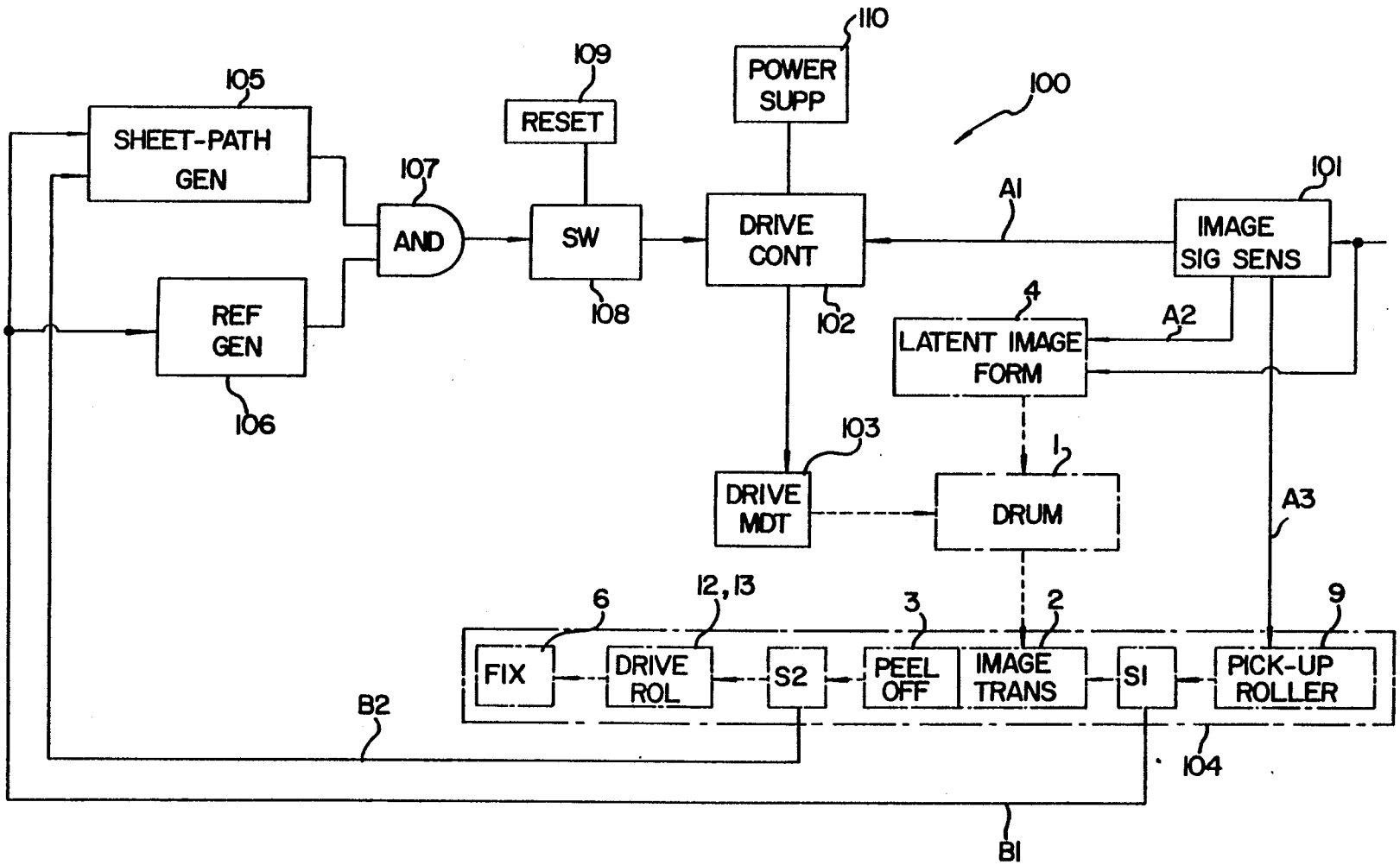
FIG. 5 is the drive control circuit operating in the image forming apparatus embodying the present invention.

The image forming apparatus embodying the present invention includes the same drive control circuit 100 as in FIG. 2. In the case of the present invention, the arrangement of the units in SHEET TRANS ROUTE 104 in FIG. 2 is changed as shown FIG. 5, and the operation of the drive control circuit 100 is same as explained in reference to FIG. 3. In FIG. 5, the same reference numeral or symbol as in FIG. 2 designates the same unit or part as in FIG. 2. In FIG. 3, a different point from the related art explained in reference to FIG. 2 is that the time duration of the sheet-path signal C1 shown in FIG. 3(*c*) becomes short and the reference time $T_r$ shown in FIG. 3(*d*) is set to a short time, compared with those in case of the related art.

Figure 6:
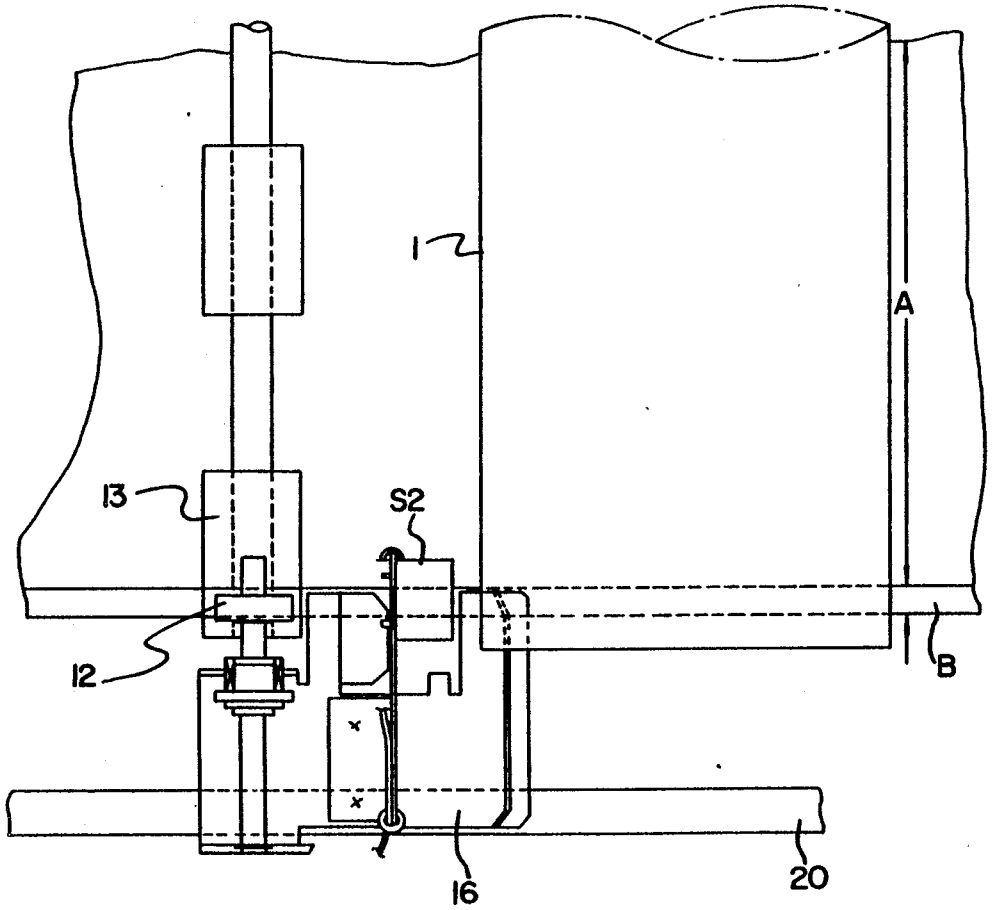
FIG. 6 is a plan view of a part, relating to the second sheet path sensor, of the image forming apparatus embodying the present invention.
Figure 7:
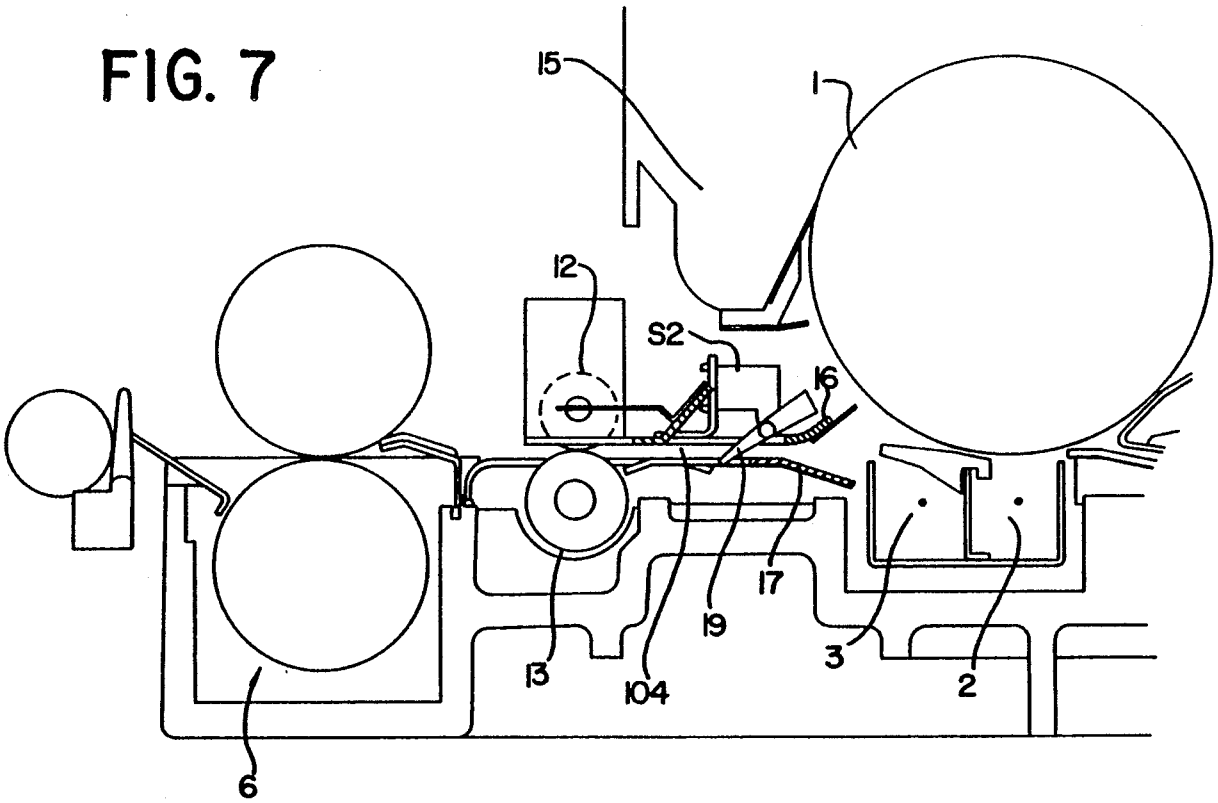
FIG. 7 is a side view of a part, relating to the second sheet path sensor, of the image forming apparatus embodying the present invention.

FIGS. 6 and 7 show respectively a plan view and a side view of a part, around the second sheet path sensor S2, of the image forming apparatus embodying the present invention. In FIGS. 6 and 7, the same reference numeral as in FIGS. 4(*a*) and 4(*b*) designates the same unit or part as in FIGS. 4(*a*) and 4(*b*). The image transcribing unit 2 and the peel-off unit 3 are adjacently arranged and placed under the drum 1 as shown in FIG. 7. An upper sheet guide piece 16 and a lower sheet guide piece 17 are provided at an exit of the cut sheet from the peel-off unit 3 for guiding the cut sheet to the driving rollers 12 and 13. The roller 13 is a drive roller driven by a driving motor not depicted in FIGS. 6 and 7, and the roller 12 is a guide roller turning with the drive roller 13. The drive roller 13 touches a back surface of the cut sheet, while the toner image is transcribed on the front surface of the cut sheet.

The guide piece 16 is fixed to a frame 20 (see FIG. 6) to which the guide roller 12 and the second sheet path sensor S2 are also provided. Different from the drive roller 13, the guide roller 12 touches the front surface of the cut sheet, however, it only touches the forbidden zone B, provided at one side of the cut sheet, of the front surface as shown in FIG. 6.

The second sheet path sensor S2 is fixed to the frame 20 so that a lever 19 of S2 is protruded into the sheet transfer route 104 when no cut sheet passes through the sheet transfer route 104, and the lever 19 is pushed up, making S2 ON, when the cut sheet passes through the sheet transfer route 104. When the lever 19 is pushed up by the cut sheet, the tip T of the lever 19 only touches the forbidden zone B. Since the lever 19 pushes the front surface downward, there is no concern that the toner image on the front surface will touch an inner surface of the upper guide piece 16 until the cut sheet arrive at the driving rollers 12 and 13, and since the tip T only touches the forbidden zone B, it is not necessary to worry that the toner image will be damaged by the tip T. Though the lever 19 pushes the cut sheet down, the cut sheet can be safely guided and transferred to the driving rollers 12 and 13 by the lower guide piece 17.

The first sheet path sensor S1 is omitted to be depicted in FIG. 7, however, S1 is provided at the entrance of the cut sheet to the image transcribing unit 2 as shown in FIG. 4(*b*) and the passage signal B1 is output therefrom when the cut sheet runs through S1. The passage signal B1 is sent to the drive control circuit 100, and when the cut sheet is passed through the peel-off unit 3 and pushes up the lever 19 normally, the passage signal B2 is produced from the second sheet path sensor S2 and sent to the drive control circuit 100.

Receiving the passage signals B1 and B2, the drive control circuit 100 judges that the cut sheet runs normally. However, if the passage signal B2 is not received though the passage signal B1 is received, the drive control circuit 100 judges that the cut sheet might be not peeled off from the cylindrical surface of the drum 1, so that the drive control circuit 100 controls the drive control to stop the drum 1, as explained in reference to FIGS. 2, 5 and 3(*a*) to 3(*d*).

Since the second sheet path sensor S2 is a mechanical sensor, an optically transparent cut sheet can be used as the cut sheet.

What is claimed is:

1. An electrophotographic image forming apparatus for transcribing an image on a cut sheet comprising:

a rotating photosensitive drum for forming a toner image on a cylindrical surface thereof;

a sheet transfer route for passing a cut sheet against said drum surface;

image transcribing means on said sheet transfer route adjacent said drum for transcribing a toner image formed on the cylindrical surface onto a cut sheet passed through said sheet transfer route;

peel-off means on said sheet transfer route for peeling the cut sheet from said cylindrical surface after image transcription;

cleaning means arranged at a point of said cylindrical surface at a rotation point after said peel-off means for cleaning said drum surface of toner;

fixing means arranged on said sheet transfer route for fixing the toner image transcribed on the cut sheet peeled off by said peel-off means;

a guide piece along said sheet transfer route between said peel-off means and said fixing means for supporting the cut sheet at a back surface of said sheet; and mechanical sheet path sensing means positioned adjacent said guide piece for sensing a cut sheet passing through said sheet transfer route, said sensing means including lever means protruding downwardly into said sheet transfer route in the absence of a cut sheet passing therethrough, said lever means being pushed upwardly by a peeled off cut sheet passing to said guide piece so as to activate said sensing means, such that force of said lever means on an upper surface of said cut sheet acts to press down said sheet and maintain said back surface of said sheet against said guide piece.

2. An electrophotographic image forming apparatus according to claim 1, wherein said lever of mechanical sheet path sensing means has a mechanism that said lever touches a forbidden zone provided at a side of a front surface of the cut sheet along a transferring direction of the cut sheet when the cut sheet passes through said sensing means, said forbidden zone being a zone on which a toner image is forbidden to be transcribed, said front surface being a surface on which the toner image is transcribed.

3. An electrophotographic image forming apparatus according to claim 1, wherein said mechanical sheet path sensing means is placed on the sheet transfer route at a distance from said peel-off means along the sheet transfer route, said distance being shorter than another distance measured along a circumference of the cylindrical surface from said image transcribing means to said cleaner means.

4. An electrophotographic image forming apparatus as recited in claim 3, further comprising another sheet path sensing means positioned along said sheet transfer route before said image transcribing means for sensing a cut sheet passing into said transcribing means, and control means for stopping rotation of said drum, based on signals from both of said sensing means, when said mechanical sheet path sensing means fails to be actuated within a given time after a passing cut sheet is senses by said another sheet path sensing means.

* * * * *